US007013682B2

(12) United States Patent
Sharrow

(10) Patent No.: US 7,013,682 B2
(45) Date of Patent: Mar. 21, 2006

(54) LAUNDRY MACHINE DOOR ASSEMBLY AND METHOD

(75) Inventor: John A. Sharrow, Redmond, WA (US)

(73) Assignee: Equator Corportion, Houston, TX (US)

( * ) Notice: Subject to any disclaimer, the term of this patent is extended or adjusted under 35 U.S.C. 154(b) by 128 days.

(21) Appl. No.: 10/444,303

(22) Filed: May 23, 2003

(65) Prior Publication Data

US 2004/0231062 A1 Nov. 25, 2004

(51) Int. Cl.
*D06F 21/02* (2006.01)
*D06F 33/00* (2006.01)
*D06F 37/10* (2006.01)

(52) U.S. Cl. ..... 68/24; 68/12.26; 68/139

(58) Field of Classification Search ..... 68/24, 68/58, 139, 140, 141, 142, 196, 12, 26
See application file for complete search history.

(56) References Cited

U.S. PATENT DOCUMENTS 5,398,528 A * 3/1995 Johnston et al. ..... 68/24
5,437,168 A * 8/1995 Mason et al. ..... 68/3 R
5,448,900 A * 9/1995 Cuthbert et al. ..... 68/139
5,469,593 A * 11/1995 Cuthbert et al. ..... 8/159
5,546,772 A * 8/1996 Merlin et al. ..... 68/24
5,678,430 A * 10/1997 Merlin et al. ..... 68/24
6,233,981 B1 * 5/2001 Grandpierre ..... 68/140
2003/0061841 A1 * 4/2003 Nakamura et al. ..... 68/12.26
2005/0076455 A1 * 4/2005 Guinibert et al. ..... 8/158
2005/0132759 A1 * 6/2005 Guinibert et al. ..... 68/24

* cited by examiner

*Primary Examiner*—Joseph L. Perrin
(74) *Attorney, Agent, or Firm*—Kenneth L. Nash

(57) ABSTRACT

A method and apparatus are herein described which provide a door assembly for the drum door and lid of a top loading horizontal axis laundry machine. The drum door is provided with an automatic latch system that can be automatically latched and unlatched on command. In a presently preferred embodiment, the automatic drum latch employs a floating latch bar which engages or disengages a latch strike attached to the drum door, depending on its orientation at the time the drum door is depressed and released. An actuator is utilized to perform the task of depressing and releasing the drum door at the proper times. When the lid of the machine is closed, the drum is rotated to a selected rotational position that determines whether the automatic drum latch will latch or unlatch after an actuator is extended to depress the drum door and then is released. This system allows both the outer laundry machine lid and the inner drum door of a top loading, horizontal axis machine to be either opened or closed with a single action on the part of the user.

8 Claims, 6 Drawing Sheets

LAUNDRY MACHINE DOOR ASSEMBLY AND METHOD

TECHNICAL FIELD

The present invention relates generally to appliances and, more particularly, to a drum door especially suitable for ease of use in operation of laundry machines having horizontal axis drums.

BACKGROUND ART

Top loading, vertical axis washing machines constitute the majority of laundry machines in the U.S., but tend to be relatively inefficient in their use of water and energy, and hard on the clothes they launder. In Europe, and in professional laundries, horizontal axis washers tend to be more popular. Horizontal axis washers use less water and energy, are more gentle, and get clothes cleaner. However, most horizontal axis machines are front-loading, requiring the user to bend over to load and unload the clothes. For many users, this disadvantage outweighs the significant benefits. There have been some prior attempts to design a top loading horizontal-axis washer, but the problems involved in opening a laundry machine outermost lid, a drum door, and in some cases an intermediate cover, have resulted in difficulties and inconvenience.

Consequently, there remains a long felt need to provide an improved laundry machine door assembly that provides all the benefits of ease of loading and simple operation of vertical axis washing machines, but also provides the superior performance and economy of horizontal axis machines. Those of skill in the art will appreciate the present invention which addresses the above problems, and other significant problems the solutions to which are discussed hereinafter.

SUMMARY OF THE INVENTION

Accordingly, it is an objective of the present invention to provide an improved drum door assembly and method for an appliance.

Another objective of one preferred embodiment of the present invention is to provide a drum door assembly and method for a horizontal axis laundry machine that is easy to operate.

These and other objectives, features, and advantages of the present invention will become apparent from the drawings, the descriptions given herein, and the appended claims. However, it will be understood that above-listed objectives of the invention are intended only as an aid in understanding aspects of the invention, are not intended to limit the invention in any way, and therefore do not form a comprehensive or restrictive list of objectives, and/or features, and/or advantages.

Accordingly, an appliance assembly may be provided that may comprise one or more elements such as, for instance, a laundry machine door assembly for a horizontal axis laundry machine. A drum is mounted within the laundry machine and the drum is configured to have a substantially horizontal rotational axis. The invention may also comprise a laundry machine lid positioned to provide access to the drum at an upper portion of the laundry machine whereby the laundry machine lid is moveable from a closed lid position to an open lid position. A drum door is pivotally mounted to the drum so as to be moveable from a closed drum door position to an open drum door position. A biasing member may preferably be provided for the drum door. The biasing member is preferably mounted to urge the drum door radially outwardly with respect to the horizontal axis. Thus, the drum door is pivotally moveable radially outwardly toward the laundry machine lid when the drum is rotationally positioned such that the drum door is adjacent the laundry machine lid.

In one preferred embodiment, the invention may further comprise an automatic latch for the drum door. The automatic latch may be controllable when the laundry machine lid is in the closed position. For instance, the automatic latch or latches may be automatically unlatched thereby unlatching the drum door to permit pivotal movement. In one presently preferred embodiment, if the laundry machine lid is moved to the open position, then the drum door may also be moved by the biasing member or other automatic means to the open drum door position to thereby expose an inner volume within the drum.

The door assembly may further comprise at least one sensor to determine the status of the drum door as being latched or unlatched. Another feature may comprise a gravity controllable latch member pivotally mounted to permit for free pivotal movement with respect to gravity when the drum door is unlatched. A control system for controlling the rotational position of the drum may be utilized to thereby control a position of the gravity controllable latch member. Another element may comprise an actuator mounted to depress the drum door inwardly toward the horizontal axis when the actuator is operated. A deflector may be attached to an edge of the drum door or elsewhere as desired to prevent laundered items from interfering with the action of the automatic latch mechanism.

In operation of one embodiment of the invention, a method is provided that may comprise one or more steps such as, for instance, rotating a drum around the substantially horizontal axis to thereby orient the drum at a first rotational position with the drum door adjacent the outermost lid for the laundry machine. Other steps may comprise unlatching the drum door to permit pivotal movement of the drum door and/or opening an outermost lid for the laundry machine to gain access to the drum and/or permitting the drum door to move to the open position in response to the biasing member to thereby gain access to an interior of the drum. In one presently preferred embodiment, the method may further comprise performing the step of unlatching the drum door prior to the step of opening the outermost lid of the laundry machine.

The method may further comprise closing the outermost lid of a laundry machine to thereby automatically latch the drum door in a closed position. The step of closing the outermost lid of the laundry may comprise initiating a sequence of steps which may include sensing a proximity of the drum door with respect to the lid of the laundry machine and/or activating an actuator.

In closing the lid of the laundry machine, the method may comprise positioning the drum at a second rotational position as part of an automatic sequence for closing the drum door.

In another preferred embodiment, a method is provided which may comprise steps such as rotating a drum around a substantially horizontal axis so that the drum may be oriented at a first rotational position with the drum door positioned adjacent the outermost lid for the laundry machine, and/or automatically unlatching a drum door prior to opening the outermost lid of the laundry machine, and/or subsequently opening the drum door as the outermost lid of the laundry machine is opened to thereby provide access to an interior of the drum. Thus, in one presently preferred embodiment, the step of unlatching the drum may be performed prior to the step of opening the outermost lid of the laundry machine.

The method may further comprise closing the outermost lid of the laundry machine to thereby close the drum door and/or automatically latching the drum door after closing the outermost lid of the laundry machine.

The method may further comprise rotating the drum to a selected position for controlling latching and unlatching of a latch for the drum door wherein the selected rotational position of the drum determines a position of a gravity responsive pivotal member of the latch.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
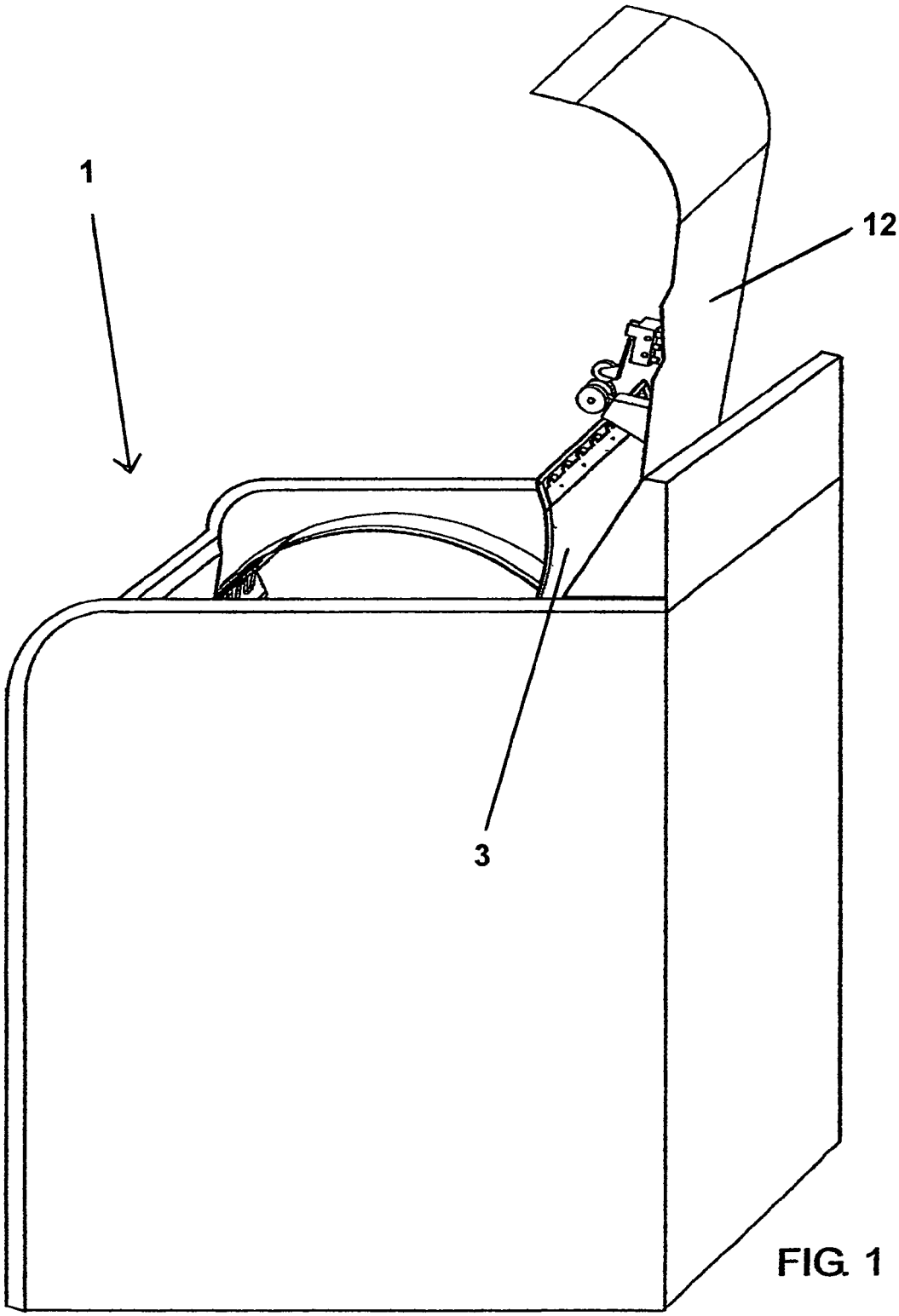
FIG. 1 is a view of a typical laundry machine according to this invention, shown with the laundry machine lid and drum door open.

Now referring to the drawings, and more particularly to FIG. 1, there is shown a presently preferred embodiment of the invention comprising horizontal axis washing machine 1 which employs one possible embodiment of a drum door assembly in accord with the present invention. Washing machine 1 is shown with both machine lid 12 and drum door 3 in the open position such that loading and unloading may be conveniently accomplished from the top of washing machine 1.

Figure 2:
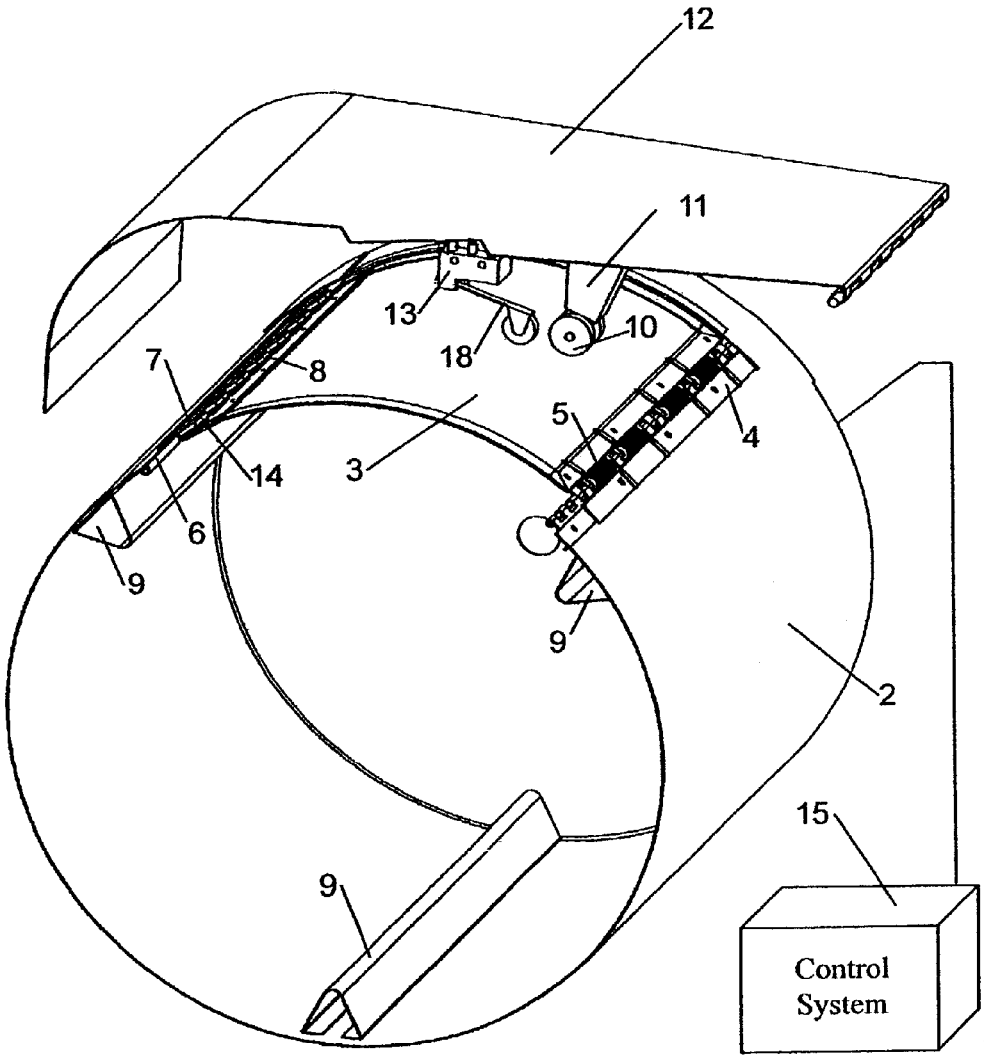
FIG. 2 is a cross sectional view of a typical horizontal axis drum, with vanes, laundry machine lid and hinge, showing a drum latch, actuator, and sensor according to the present invention.

As shown perhaps more clearly in FIG. 2, drum 2 is mounted to allow rotation about a horizontal axis. Drum 2 has an access opening that is fitted with a drum door 3, which is shown in the closed position in FIG. 2. Drum door 3 is attached to drum 2 by a pivotal connection such as hinge 4. Hinge 4 may comprise any suitable pivotal mounting for drum door 3. The drive mechanism (not shown) that rotates drum 2 for the purpose of washing, rinsing, and spin drying the clothes load is configured to include an electronic, and/or electromechanical, and/or mechanical, and/or hydraulic, and/or pneumatic control system 15 capable of rotating the drum 2 by means of the drive mechanism to a predetermined position and retaining drum 2 in that position. As will be seen subsequently, the position of drum 2 will be used to control operation of latch 7. Vanes 9 may be utilized within the drum to agitate clothing for improved washing that occurs due to greater water flow through and across the washed items.

Figure 3:
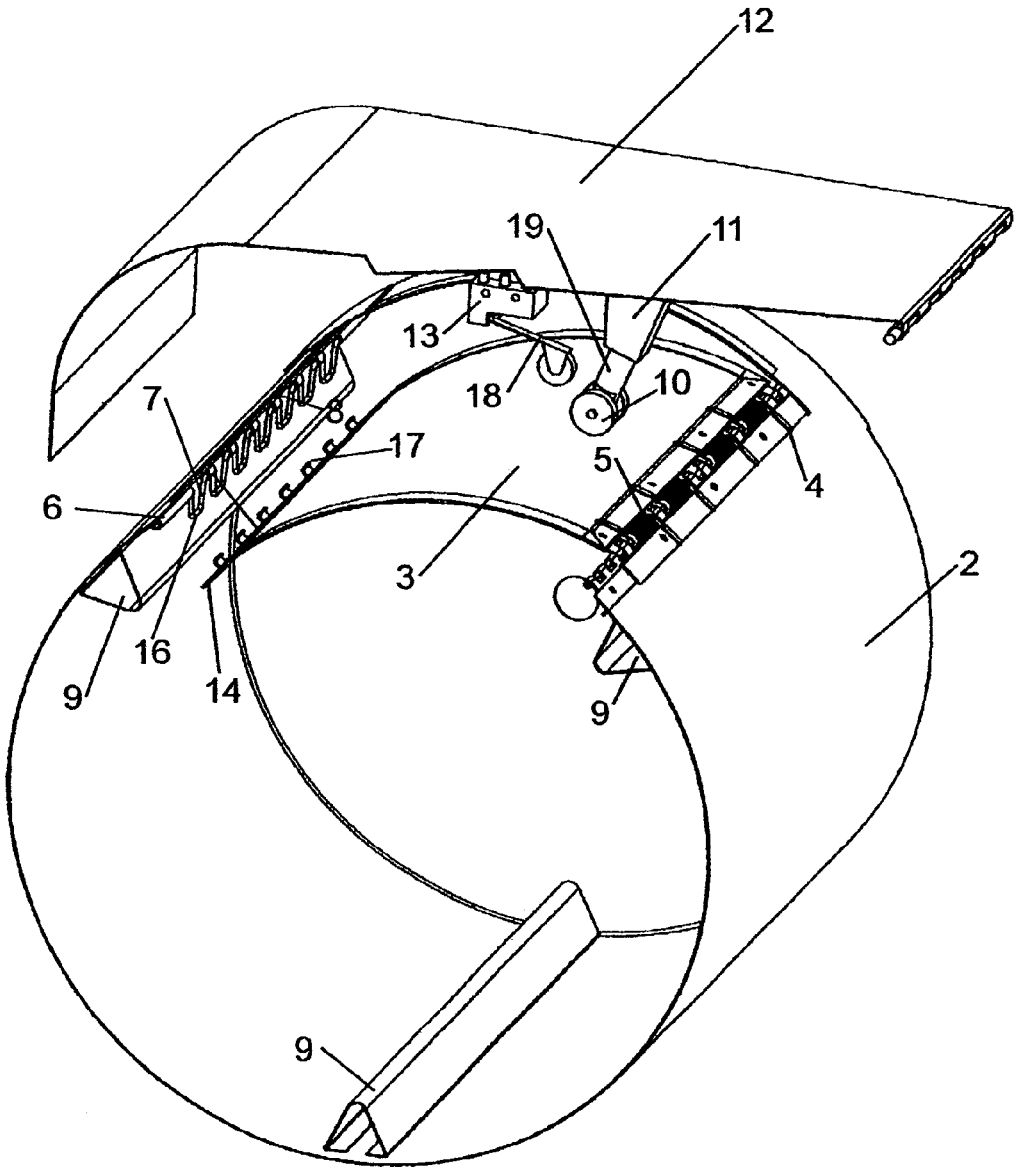
FIG. 3 represents the operation of the actuator and sensor showing the relative position of the drum as the drum door is being unlatched.
Figure 4:
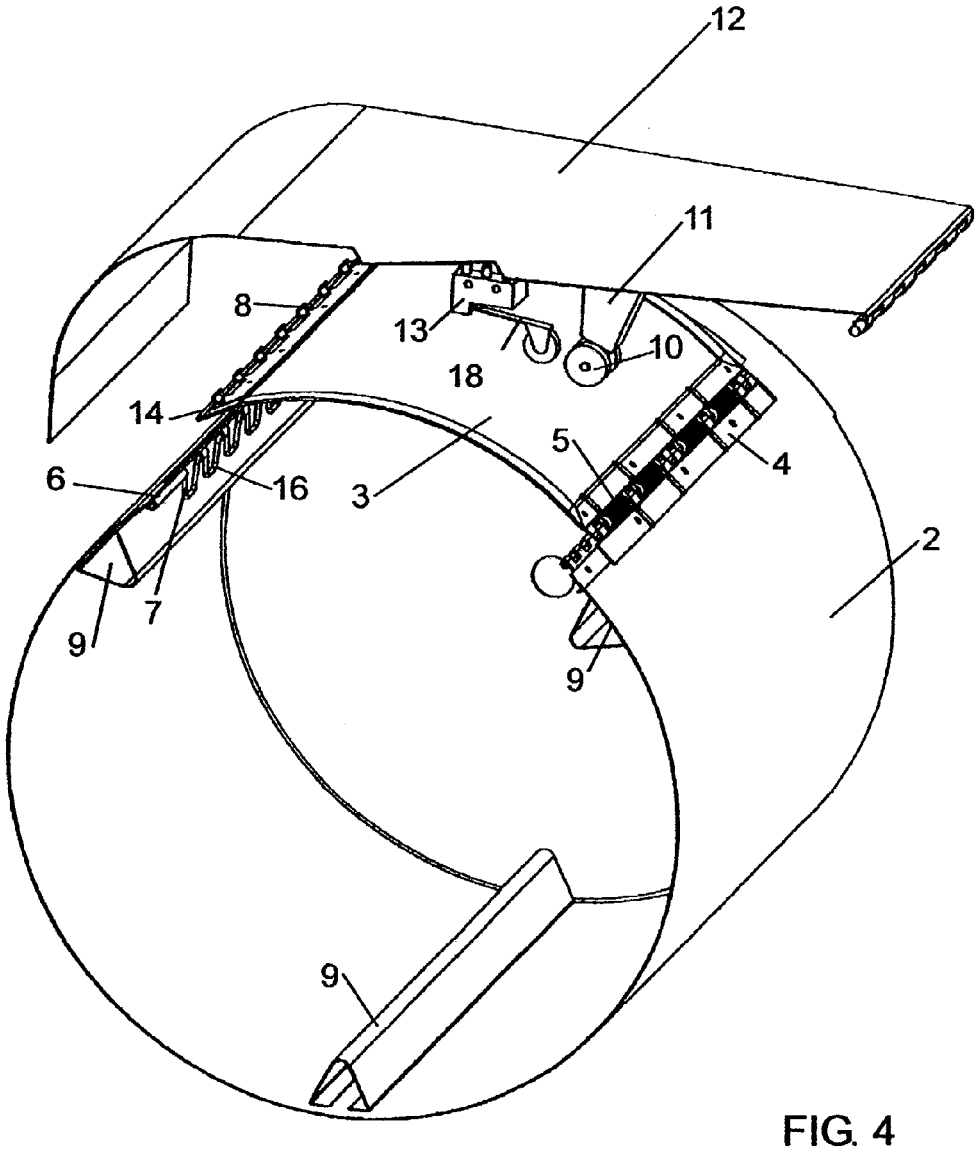
FIG. 4 is a cross sectional view showing the drum door unlatched, with the laundry machine lid still in a closed position.

As shown in FIG. 2 and perhaps more clearly in FIG. 3, latch bar 7 is preferably pivotally attached to drum 2 by means of pivotal mounting 6. In a presently preferred embodiment latch bar 7 is elongate and comprises a plurality of bends or catches 16. In one embodiment, latch strike 8 is mounted to drum door 3. However, the latching components latch strike 8 and latch bar 7 may be reversed in position if desired with appropriate changes in operation as will be understood after reviewing the principles of operation discussed hereinafter. Latch strike 8 is also elongate and mates with latch bar 7, depending on the rotational position of latch bar 7 as discussed hereinafter. Latch strike 8 comprises a plurality of hooks mounted thereto along its length. Assuming latch bar 7 is in the appropriate rotational position for catching, then the plurality of catches 16 will engage with the plurality of hooks 17 formed on latch strike 8 when drum door 3 moves from the inward position shown in FIG. 3 radially outwardly. When catches 16 on latch bar 7 are engaged with hooks 17 latch strike 8, the so-formed latching mechanism holds drum door 3 in a closed position, as shown in FIG. 2. On the other, if latch bar 7 is in a rotational position to prevent catching, then drum door 3 will not catch as drum door moves from the inward position but will pass by latch strike 8 and be moveable to a drum door 3 open position as shown in FIG. 1 and/or an initially open position as shown in FIG. 4.

Figure 5:
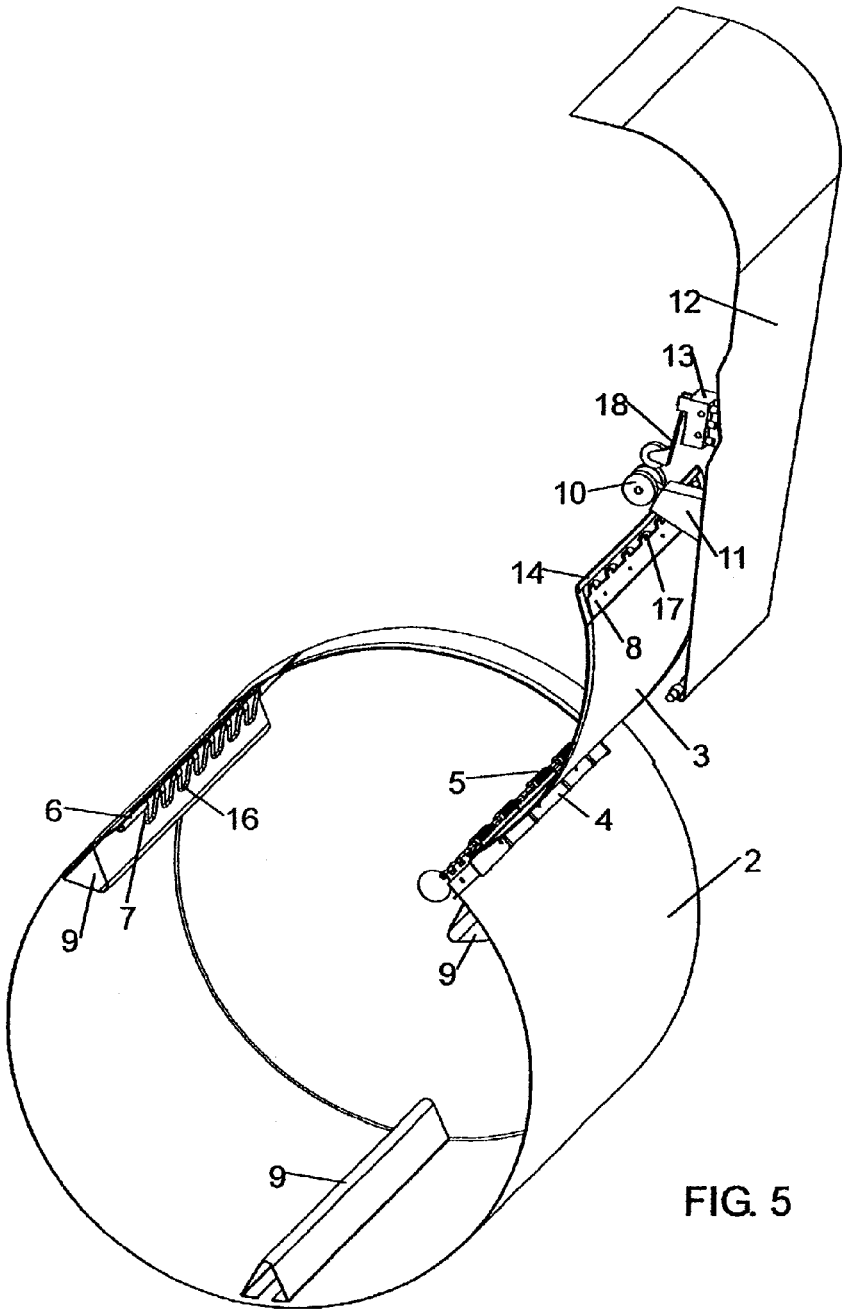
FIG. 5 is a cross sectional view of a horizontal axis drum, with the drum door and the laundry machine lid both shown in an unlatched and open position.

Drum door 3 is preferably spring loaded or biased. One presently preferred means for providing this bias utilizes springs 5 which are secured on both sides of hinge 4 to apply a torsional force which, if unopposed, will cause drum door 3 to rotate outwardly away from drum door 3 and extend to a fully open position, as shown in FIG. 1 and FIG. 5.

Actuator 11 may be an electric, hydraulic, or pneumatic actuator. In this embodiment, actuator 11 preferably comprises an extendable/retractable arm 19, as best shown in FIG. 3, when arm 19 is extended. Arm 19 may be moved outwardly to an extended position as shown in FIG. 3 or inwardly to a retracted position as shown in FIG. 2. Other types of arms or actuators could be utilized such as a rotating arm, cam, pivotal member, or the like. In this embodiment, actuator 11 is mounted on the underside of laundry machine door 12 and above drum 2 so as to be above drum door 3 when drum door 3 is positioned upwardly by control system 15. Other mounting positions, such as to the side of the machine housing or the like, may also be utilized with appropriate mechanical and/or electromechanical modifications in accord with the operating principles discussed herein. A suitable contact member such as roller 10 is secured to extendable arm 19 and utilized to contact drum door 3.

In FIG. 2, with arm 19 in the retracted position, roller 10 is not in contact with drum door 3. In FIG. 3, with arm 19 in the extended position, roller 10 has engaged drum door 3 and pushed drum door 3 to rotate inwardly for reasons to be discussed subsequently. Actuator 11 may be activated or controlled by a control system such as control system 15.

Sensor 13 is utilized to determine the relative position of drum door 3 and/or to determine whether drum door 3 is unlatched or latched. Sensor 13 may be of many different readily available sensor types such as contact switches, opto sensors, or hall effect devices, or the like. In the embodiment shown, sensor 13 utilizes arm 18 to control a switch that when activated or deactivated due to contact or loss of contact with drum door 3 provides the necessary door-open or door-closed proximity information for operation of the latch assembly of the present invention. As noted above, In FIG. 2 and FIG. 3 arm 18 is not in engagement with drum door 3. Therefore, sensor 13 indicates that drum door 3 has not been opened outwardly. The sensor signal may be relayed to control system 15.

Referring to FIG. 3, the initial step for a drum door opening sequence in accord with the present invention is illustrated. The opening sequence may begin, for instance, in response to pressing a button, switch, voice signal, or perhaps automatically after a washing cycle is completed. In any case, drum 2 is rotated, if this step has not already been accomplished, to the approximate rotational position shown so that drum door 3 is in an upward position and adjacent machine lid 12.

Control system 15 activates actuator 11, thereby bringing roller 10 into contact with drum door 3 to push drum door 3 to an inward position as shown. As drum door 3 is deflected downward from its closed position, latch bar 7 is moved downward to disengage with latch strike 8. After disengagement of latch bar 7 with strike 8, catches 16 on pivotally mounted latch bar 7 rotate and point downwardly due to gravity, biasing members such as springs, or other devices acting thereon. The rotational position of drum 2 thereby controls the rotational position of latch bar 7 because catches 16 rotate to point downwardly in response to the force of gravity. The rotational position of drum 2 determines whether drum door 3 latches or opens once actuator 11 is retracted again. Actuator arm 19 is then retracted. If drum 2 is in the rotational position shown in FIG. 3 so that latch bar 7 is off-center whereby catches 16 are moved sufficiently far away from hooks 17, then when drum door is pushed open by spring 5 as actuator arm 19 retracts, hooks 17 will not engage catches 16 and drum door 3 will continue moving outwardly. Preferably, drum 2 is rotated by control system 15 so that the opening of drum door 3 between latch bar 7 and strike 8 is approximately below the opening of laundry machine door 12. Thus, when actuator 11 is deactivated by control system 15 and roller 10 or arm 19 retracts, then the torsional force of springs 5 causes drum door 3 to rotate toward an intermediate open position or unlatched position as shown in FIG. 4.

In a presently preferred embodiment, deflector 14, which may comprise a plate, bar, or other suitable element, is positioned below latch strike 8, or on the end of drum door 3, to thereby block or prevent clothing articles in drum 2 from interfering with the operation of latch bar 7 and latch strike 8.

As shown in FIG. 4, in the intermediate open position or unlatched position, drum door 3 is prevented from opening fully by the presence of lid 12 but is free to move outwardly until contacting roller 10. When drum door 3 moves to this partially open position as best shown in FIG. 4, arm 18 on sensor 13 rotates to alter a switch position of sensor 13 thereby indicating that drum door 3 is unlatched, partially open, and ready to move to the open position. This information is provided to control system 15.

Means or indicator lights may be provided to let the operator know that lid 12 may now be opened manually. Alternatively, lid 12 may also be spring-loaded or otherwise automated. For instance a lid latch (not shown) may be provided for lid 12 that is unlatched at this time whereby lid 12 opens automatically along with drum door 3 to the open position shown in FIG. 1 and FIG. 5. Lid 12 may have hydraulic dampers to make the opening smooth.

In one possible embodiment of the present invention, an open button may be pushed by the operator that causes control system 15 to effect the entire opening sequence, thereby automatically opening both doors. In any case, whether lid 12 is opened manually as is normal with vertical axis laundry machines or is opened entirely automatically, lid 12 and drum door 3 are conveniently opened in one simultaneous action in accord with the present invention. Moreover, after review of the drawings and discussion above, it will be understood that regardless of the mechanism used for opening lid 12, once lid 12 is opened, then spring 5 causes drum door 3 to continue to rotate toward a fully open position, as lid 12 opens, as depicted in FIGS. 1 and 5. If lid 12 is spring-loaded rather than manual, then lid 12 may be closed manually until a lid latch (not shown) catches. If lid 12 is automatically controlled by actuators, then a button may be used to start a close sequence as discussed below. Thus, lid 12 may be opened manually, partially automatically, or fully automatically in accord with the present invention.

The closing sequence of drum door 3 is substantially the opposite of the opening sequence discussed above. It will be noted that when lid 12 is opened then spring-loaded sensor arm 18 on sensor 13 moves outwardly indicated that drum door 3 is no longer in proximity therewith. In the illustrated embodiment, as lid 12 is closed, then drum door 3 is pressed downward by roller 10, reverting to the position shown in FIG. 4 thereby activating sensor 13 to activate a drum door latching sequence. Depending on the particular construction, other sensors besides sensor 13 could also be utilized to initiate the drum door latching sequence and/or other means such as other actuators besides actuator 11 could be provided to press door 3 inwardly.

Figure 6:
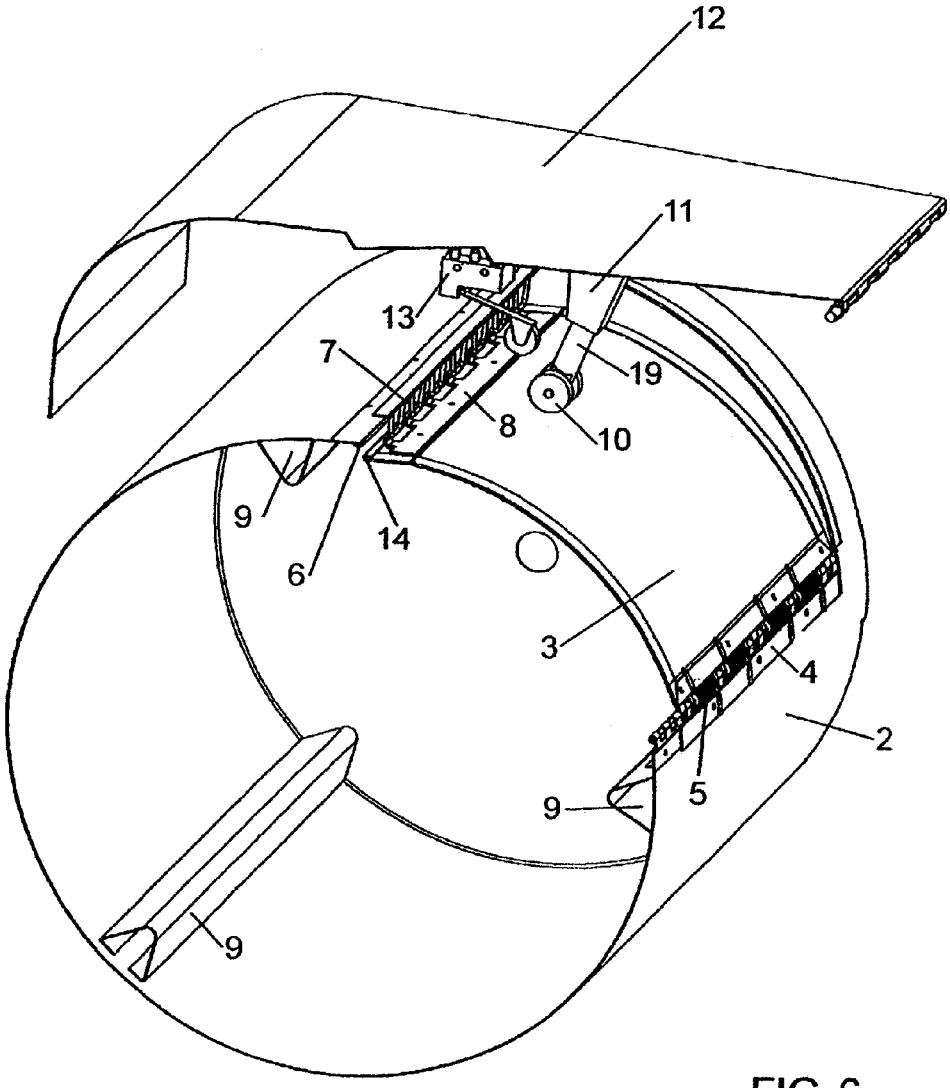
FIG. 6 shows the operation of the actuator and the relative rotational position of the drum door when latching the drum door to place the drum door in the closed position.

When the drum door latching sequence is initiated, then control system 15 rotates drum 2 to the rotational position shown in FIG. 6 thereby placing latch bar 7 in an upper circumferential position of drum 2. This action thereby changes the rotational orientation of latches 16 due to gravity to thereby orient latches 16 and hooks 17 so that latching will now occur, as discussed above and reviewed below.

Once control system 15 senses that drum 2 positioned as shown in FIG. 6, then actuator 11 is activated, causing roller 10 to depress drum door 3 inwardly so that latch strike plate 8 passes by latch bar 7 as drum door is moved inwardly once again. Then actuator 11 begins to retract to allow drum door 3 to move outwardly again due to force produced by spring 5. However, because latch bar 7 has been rotated whereby catches 16 are much closer to hooks 17, now hooks 17 engage catches 16 to thereby secure strike 8 with latch bar 7. When actuator 11 is subsequently completely deactivated, roller 10 retracts and drum door 3 assumes the closed position shown in FIG. 2. Sensor 13 confirms that drum door 3 is now in the latched state. Thus, machine 1 is now ready to begin a washing cycle. It will be noted that as drum door 3 rotates even further clockwise than as shown in FIG. 6, that the catches 16 will rotate further toward hook 17. However, in a presently preferred embodiment, drum 3 may be positioned with the hook-catch latch mechanism toward the upper portion of the cycle to avoid interference with clothes or other articles to be washed.

In operation of one possible embodiment of the invention, the user may conveniently press a button or the like when it is desired to open the laundry machine to the open position as shown in FIG. 1. Control system 15 then begins a sequence of steps as illustrated in FIG. 2–FIG. 5 for opening drum door 3, although the user simply sees a convenient one-step process. Control system 15 positions drum 2 at the desired rotational position as indicated in FIG. 2 and/or verifies the position. It may be desirable that drum 2 normally is placed in this position after washing. Once the drum rotational position is verified, then actuator 11 moves drum lid 12 downwardly as shown in FIG. 3 whereby catches 16 disengage from hooks 17. Due to the rotational position of drum 2, latch elements or catches 16 then rotate out of the ambit of hooks 17 so that drum door 3 can be opened. Actuator 11 then retracts so that drum door 3 moves outwardly with respect to drum 2 to a partially open position as shown in FIG. 4 due to the outwardly biasing force of spring 5. Sensor 13 is tripped and detects that drum door 3 is unlocked and available to be opened. Laundry machine lid 12 may then be raised either automatically, by spring-bias, manually, or the like, and spring-biased drum door 3 automatically opens at the substantially same time that laundry lid 12 opens as shown in FIG. 5.

When it is desired to close the laundry machine, e.g., after putting clothes therein, then the user simply closes laundry lid 12 as indicated in FIG. 6. Upon detection of drum door 3 by sensor 13, or other sensors to sense the beginning of a door close sequence, then drum 3 is rotated to another position, such as the position shown in FIG. 6, whereby catches 16, which are mounted on pivotal latch bar 7 will now engage hooks 17. Actuator 11 is extended to push drum door 3 inwardly, and then released to cause drum door 3 to securely latch by means of catches 16 and hooks 17. The laundry machine can now begin to operate. The user will be aware of only a one-step operation to simultaneously close both laundry machine lid 12 and drum door 3.

Various other types of drum latches could also be utilized, whereby the same one-step operation could be accomplished and it will be understood that the present invention is not limited to any particular latch so long as the drum latch is controllable to permit simultaneous operation of drum door 3 and laundry machine lid 12. For instance, an electromechanical drum door latch mechanism may be utilized to effect the one-step opening drum door/lid opening and closing. While a washing machine is disclosed herein, the present invention may be utilized with any laundry machine.

The foregoing disclosure and description of the invention is therefore illustrative and explanatory of presently preferred embodiments of the invention and variations thereof, and it will be appreciated by those skilled in the art, that various changes in the design, organization, order of operation, means of operation, equipment structures and location, methodology, the use of mechanical equivalents, such as different types of latches than as illustrated whereby different steps may be utilized, as well as in the details of the illustrated construction or combinations of features of the various elements may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be varied from that shown and the invention still operate well within the spirit of the invention as described hereinbefore and in the appended claims. Thus, various changes and alternatives may be used that are contained within the spirit of the invention.

Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. A door assembly for a horizontal axis laundry machine having a drum mounted within said laundry machine, said drum being configured to have a substantially horizontal rotational axis, said door assembly comprising:

a laundry machine lid positioned to provide access to said drum from above a circumference of said drum, said laundry machine lid being moveable from a closed lid position to an open lid position;

a drum door pivotally mounted to a circumferential portion of said drum so as to be moveable radially outwardly from a closed drum door position to an open drum door position and so as to be radially inwardly moveable to a latch released position;

a gravity controllable latch member comprising a first side and a second side; and a pivotal connection which pivotally connects said gravity controllable latch member with respect to said drum such that when said drum door is moved radially inwardly to said latch released position then said second side pivots with respect to said first side in a direction downwardly toward Earth in response to a gravitational force acting on said gravity controllable latch member.

2. The door assembly of claim 1, further comprising a control system operable to move said drum to a first rotational position such that when said drum door is in said latch released position then said first side and second side of said gravity controllable latch member are oriented so that an edge of said drum door is free to move past said gravity controllable latch member to permit said drum door to move to said open drum door position, said control system being operable to move said drum to a second rotational position such that when said drum door is in said latched released position then said first side and said second side of said gravity controllable latch member are oriented so that said edge of said drum door is not free to move past said gravity controllable latch member.

3. A door assembly for a horizontal axis laundry machine having a drum mounted within said laundry machine, said drum being configured to have a substantially horizontal rotational axis, said door assembly comprising:

a laundry machine lid positioned to provide access to said drum from above a circumference of said drum, said laundry machine lid being moveable from a closed lid position to an open lid position;

a drum door pivotally mounted to a circumferential portion of said drum so as to be moveable from a closed drum door position to an open drum door position and so as to be radially inwardly moveable to a latch released position;

a latching edge for said drum door;

a biasing member for said drum door, said biasing member being mounted to urge said drum door radially outwardly with respect to said horizontal axis and toward said laundry machine lid when said drum is rotationally positioned such that said drum door is adjacent said laundry machine 1id; and a gravity controllable latch member comprising a first side and a second side, said second side of said gravity controllable latch member being profiled to permit latching and unlatching with respect to said latching edge, said gravity controllable latch member being pivotally connected with respect to said drum so that when said drum door is moved radially inwardly to said latch released position, then in response to a gravitational force acting on said gravity controllable latch member said second side pivots downwardly toward Earth with respect to said first side whereby an orientation of said first side and said second side of said gravity controllable latch is dependent on said gravitational force acting thereon which gravitational force changes due to the rotational position of the drum.

4. The door assembly of claim 1, further comprising:

at least one sensor to determine the status of said drum door as being latched or unlatched.

5. The door assembly of claim 1, further comprising:

a control system for controlling said orientation of said gravity controllable latch member by controlling said rotational position of said drum to thereby selectively permit said drum door to move from said latch released position to said closed drum door position or alternatively to move from said latched released position past said closed drum door position to said open drum door position.

6. The door assembly of claim 5, wherein said control system is operable to unlatch said gravity controllable latch member to permit said drum door to move to said open drum door position by moving said drum to a first rotational position such that when said drum door is in said latch released position then said first side and second side of said gravity controllable latch member are oriented so that said latching edge of said drum door is free to move radially outwardly past said gravity controllable latch member, said control system being operable to latch said gravity controllable latch member to secure said drum door in said closed drum position by moving said drum to a second rotational position such that when said drum door is in said latched released position then said first side and said second side of said gravity controllable latch member are oriented so that said latching edge of said drum door is not free to move past said gravity controllable latch member but instead is engageable with said gravity controllable latch member.

7. The door assembly of claim 1, further comprising:

a drum door actuator mounted so as to allow said actuator to depress said drum door radially inwardly toward said horizontal axis to said latch released position when said drum door actuator is operated.

8. The door assembly of claim 1, further comprising:

a deflector attached to an edge of said drum door to prevent items being laundered from interfering with the action of said gravity controllable latch member.

* * * * *